US010449974B2

(12) United States Patent
Fray et al.

(10) Patent No.: US 10,449,974 B2
(45) Date of Patent: Oct. 22, 2019

(54) TWO-FLOOR PASSENGER RAILWAY CAR AND TRAIN COMPRISING SUCH A CAR

(71) Applicant: ALSTOM TRANSPORT TECHNOLOGIES, Saint-Ouen France (FR)

(72) Inventors: Benoit Fray, Lambersart (FR); Bertrand De Colombel, Paris (FR); Xavier Allard, Clamart (FR); Carole Vannier, Paris (FR); Alexis Bonnet, Paris (FR); Lionel Graf, Paris (FR); Olivier Velay, Paris (FR)

(73) Assignee: Alstom Transport Technologies, Saint-Ouen (FR)

( * ) Notice: Subject to any disclaimer, the term of this patent is extended or adjusted under 35 U.S.C. 154(b) by 202 days.

(21) Appl. No.: 14/962,310

(22) Filed: Dec. 8, 2015

(65) Prior Publication Data

US 2016/0159372 A1 Jun. 9, 2016

(30) Foreign Application Priority Data

Dec. 8, 2014 (FR) ..... 14 62068

(51) Int. Cl.
*B61D 1/06* (2006.01)
*B61D 23/00* (2006.01)
*B61D 33/00* (2006.01)

(52) U.S. Cl.
CPC ..... *B61D 1/06* (2013.01); *B61D 23/00* (2013.01); *B61D 33/0007* (2013.01)

(58) Field of Classification Search
CPC ..... B61D 1/06; B61D 17/08; B61D 13/02; B61D 23/00; B61D 33/0007
See application file for complete search history.

(56) References Cited

U.S. PATENT DOCUMENTS 2,405,136 A * 8/1946 Dittrich ..... B61D 1/06 105/340
2003/0056686 A1* 3/2003 Morlok ..... B61D 1/06 105/443

FOREIGN PATENT DOCUMENTS

AU 2004212556 A1 * 4/2005 ..... B61D 1/06
GB 233617 A * 5/1925 ..... B61D 13/02
WO WO 0168430 A2 * 9/2001 ..... B61C 3/00

* cited by examiner

*Primary Examiner* — S. Joseph Morano
*Assistant Examiner* — Scott A Browne
(74) *Attorney, Agent, or Firm* — Knobbe, Martens, Olson & Bear, LLP

(57) ABSTRACT

A railway car includes a passenger compartment having, in a central segment of the compartment, a lower floor and an upper floor superposed with each other, respectively defining a lower story and an upper story, and, in end segments of the compartment, two platforms each connected to the lower floor through a descending passage and to an upper floor through an ascending passage. At least one platform is equipped with at least one row of longitudinal seats leaning against a side face of the railway car.

14 Claims, 2 Drawing Sheets

TWO-FLOOR PASSENGER RAILWAY CAR AND TRAIN COMPRISING SUCH A CAR

CROSS-REFERENCE TO RELATED APPLICATIONS

This application claims priority to French Patent Application No. FR 14 62068 filed on Dec. 8, 2014, the disclosure of which including the specification, the drawings, and the claims is hereby incorporated by reference in its entirety.

TECHNICAL FIELD OF THE INVENTION

The present invention relates to the field of passenger transport railway vehicles, and in particular passenger transport rail cars comprising two superposed storys.

BACKGROUND OF THE INVENTION

In order to increase the capacity of a passenger transport railway car, it is possible to provide the railway car with superposed lower floor and upper floor, respectively defining a lower story and an upper story for the passengers.

The increase in the number of passengers in a railway car is accomplished to the detriment of the ease of circulation of the passengers in the railway car, and to the rapidity of boarding and disembarking passengers.

Now, the railway transport operators desire that the passengers be able to circulate in a fluid way in railway cars, and to rapidly board and disembark in order to minimize the immobilization time of railway cars in a station.

Further, the railway transport operators wish to propose railway cars with ergonomic and comfortable interior fixtures for the passengers.

One of the objects of the invention is to propose a railway car giving the possibility of receiving a large number of passengers with satisfactory ergonomics for the passengers.

SUMMARY OF THE INVENTION

For this purpose, the invention proposes a two-floor passenger transport railway car, comprising a passenger compartment having, in a central segment of the compartment, a lower floor and an upper floor superposed with each other, respectively defining a lower story and an upper story, and, in end segments of the compartment, two platforms each connected to the lower floor through a descending passage and to the upper floor through an ascending passage, wherein at least one platform is equipped with at least a row of longitudinal seats leaning against a side face of the railway car.

The railway car optionally comprises one or several of the following features, taken individually or according to all the technically possible combinations:

- at least one platform is equipped with two rows of longitudinal seats, each leaning against a respective side face;
- at least one platform, preferably each platform, is served by a side access door;
- at least one platform equipped with a row of longitudinal seats leaning against a side face is served by a side access door placed on this side face longitudinally between the row of longitudinal seats on the one hand and the descending passage and the ascending passage on the other hand connecting the platform to the lower floor and to the upper floor;

- each ascending passage connecting a platform to the upper floor is narrower than the descending passage connecting this platform to the lower floor;
- the ratio of the width of the ascending passage over that of the descending passage is comprised between 0.4 and 0.8, notably between 0.6 and 0.8.
- the upper story and the lower story are provided with fixture of seats with respective different comfort levels;
- one of the upper story and of the lower story is equipped with at least one row of seats comprising a common backrest and/or a common seat surface, the other one being equipped with individual seats;
- the lower story is equipped with at least one row of seats comprising a common back seat and/or a common seat surface, and the upper story is equipped with individual seats;
- it comprises an information display banner located inside the car and continuously extending on a side face at least along a platform and the upper floor and/or an information display banner located inside the car and continuously extending on a side face at least along a platform and the lower floor;
- it comprises, at a longitudinal end at least, an intercirculation passage for which the width is greater than 50% of the width of the car, notably than 60% of the width of the car.

The invention also relates to a railway train comprising at least one railway car as defined above.

BRIEF DESCRIPTION OF THE DRAWINGS

The invention and its advantages will be better understood upon reading the description which follows, only given as a non-limiting example, and made with reference to the appended drawings, wherein.

DETAILED DESCRIPTION OF SOME EMBODIMENTS

The railway car 2 illustrated in FIGS. 1 to 4 is a passenger transport railway car 2. The railway car 2 is able to be integrated into a railway train comprising several railway cars in a line.

The railway car 2 extends along a longitudinal direction L and has two longitudinal ends.

The railway car 2 has a rigid box 4 delimiting a passenger compartment 6 extending over the whole length of the box 4. The railway car 2 has two bogies located in proximity to the longitudinal ends of the car, and on which the box 4 lies.

Figure 1:
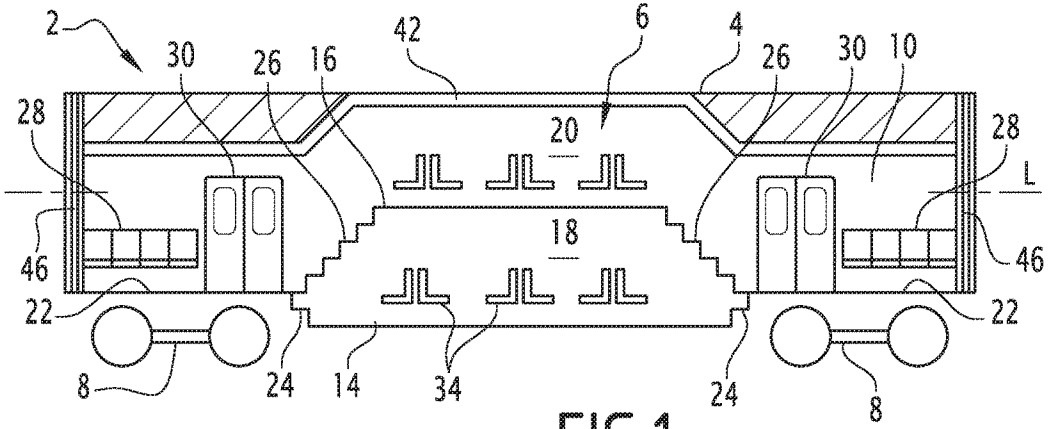
FIG. 1 is a schematic longitudinal sectional view of a railway car, illustrating the interior fixtures of the railway car, as seen from a side along I-I in FIG. 3.
Figure 2:
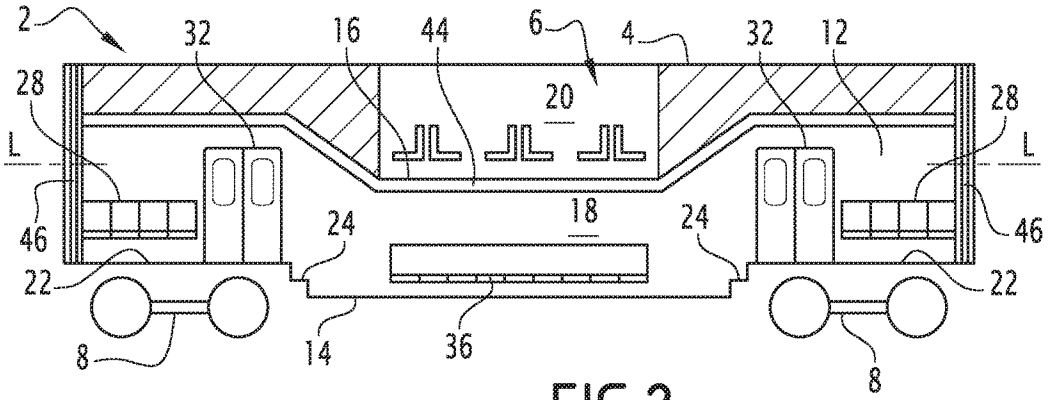
FIG. 2 is a schematic longitudinal sectional view of the railway car of FIG. 1, illustrating the interior fixtures of the railway car, as seen from the other side along II-II in FIG. 3.

The box 4 comprises two opposite side faces 10, 12. Each side face 10, 12 delimits a respective side of the box 4. FIGS. 1 and 2 each show a respective side face 10, 12.

The passenger compartment 6 has a central segment and two end segments.

The passenger compartment 6 has, in the central segment, a lower floor 14 and an upper floor 16 superposed with each other. The lower floor 14 is located above the upper floor 16. The upper floor 16 extends over the whole of its surface above the lower floor 14.

The lower floor 14 and the upper floor 16 respectively define a lower story 18 and an upper story 20 of the railway car 2, made for the passengers.

The passenger compartment 6 has, in each end segment, an intermediate platform 22. Each platform 22 is located at an intermediate height between the height of the lower floor 14 and the height of the upper floor 16. Each platform 22 is located above a respective bogie 8.

Each platform 22 is connected to the lower floor 14 through a descending passage 24 and to the upper floor 16 through an ascending passage 26.

The railway car 2 comprises a single ascending passage 26 connecting each platform 22 to the upper floor 16 and a single descending passage 24 connecting each platform 22 to the lower floor 14.

Each platform 22 is connected directly to the lower floor 14 by a descending passage 24. Each descending passage 24 descends from a platform 22 to the lower floor 14 with extending longitudinally in one single direction, i.e. from the end segment in which the platform 22 is located towards the central segment. The descending passage 24 has no U-turn.

Each platform 22 is connected directly to the upper floor 16 by an ascending passage 26. Each ascending passage 26 ascends from a platform 22 to the upper floor 16 with extending longitudinally in one single direction, i.e. from the end segment in which the platform 22 is located towards the central segment. Each ascending passage 24 has no U-turn.

Each ascending passage 26 comprises a staircase, typically comprising between 4 and 10 steps. Each descending passage 24 comprises a staircase and/or a ramp. A staircase of a descending passage 24 typically comprises between 1 and 6 steps. A ramp preferably has a maximum slope of 8%.

At least one platform 22 is equipped with at least one row of longitudinal seats leaning against a side face of the car. A row of longitudinal seats forms a longitudinal row.

As illustrated, each platform 22 is equipped with two rows of longitudinal seats 28, each row of longitudinal seats leaning against a respective side face 10, 12.

These seats are intended for passengers undertaking short trips for example trips of the order of five to ten minutes.

A longitudinal seat refers to a seat for which the back seat substantially extends along the longitudinal direction. The seat is thus oriented so that the axis joining the shoulders of a passenger sitting on the seat is aligned with the longitudinal direction L, the passenger looking in a transverse direction.

A transverse seat refers to a seat for which the back seat substantially extends perpendicularly to the longitudinal direction. The seat is thus oriented so that the axis joining the shoulders of a passenger is perpendicular to the longitudinal direction, the passenger looking in the longitudinal direction.

According to an alternative, a platform 22 is equipped with two rows of longitudinal seats, and the other platform 22 is equipped with a single row of longitudinal seats.

According to another alternative, each platform 22 is equipped with a single row of longitudinal seats, the row of a platform 22 leaning against the same side face as that of the other platform 22, or against the other side face.

According to still another alternative, a single one of the two platforms 22 is equipped with longitudinal seats, the other platform 22 being without any seats. In this alternative, the platform 22 without any seats may be provided shorter than the platform 22 equipped with seats. As a counterpart, the lower 14 and upper 16 floors may be provided longer in order to increase the capacity of the railway car 2.

Optionally, seats leaning against side faces of a platform 22 are foldable seats, for which the seat surfaces may be raised, for example in order to give room in the case of a crowd.

Figure 3:
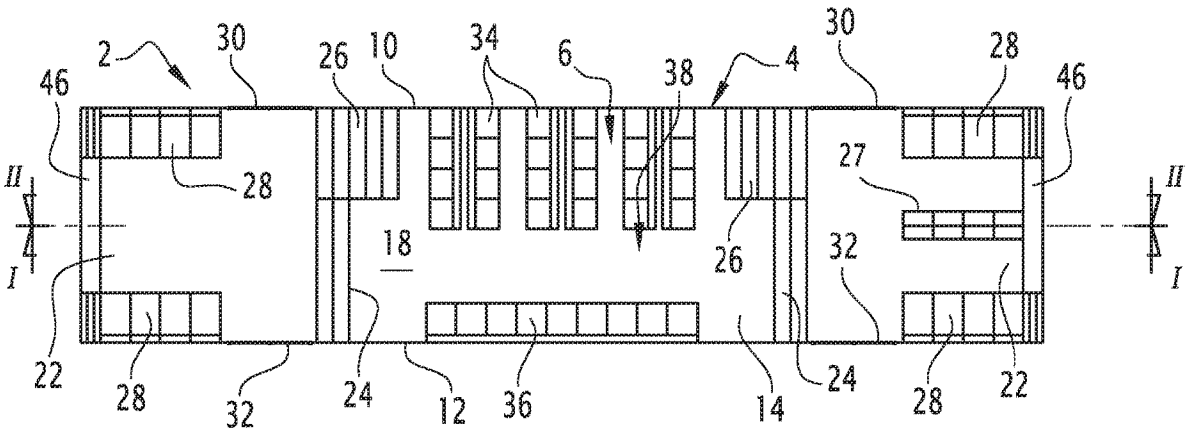
FIGS. 3 and 4 are top views of the railway car of FIGS. 1 and 2, respectively illustrating a lower story and an upper story of the railway car.
Figure 4:
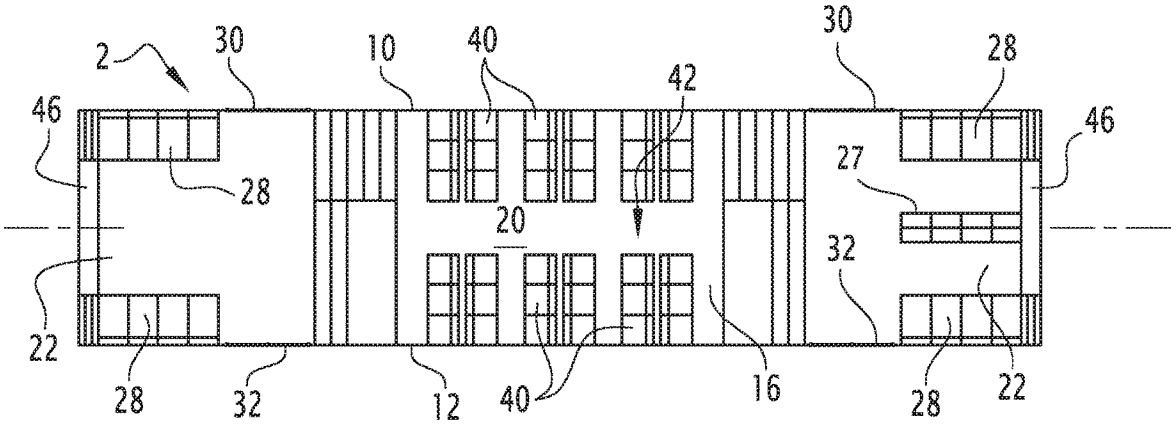

Alternatively, as visible in FIGS. 3 and 4, at least one platform 22 comprises a supporting device 27, for example a row of longitudinal supports positioned in the middle of the platform 22, preferably facing the rows of longitudinal seats 28. A supporting device 27 allows the passengers to be supported against the supporting device 27 while remaining standing. The supporting device 27 for example comprises supports in the form of back seats substantially located at the height of the thigh or bottom of the back of a passenger of an average size. Thus, notably in the case of a large crowd, the supporting device 27 provides better comfort to the passengers present at the platform 22, while not interfering with the flow of traffic of passengers towards/from the vehicle adjacent to the platform 22.

At least one platform 22 is served by a side access door provided on a side face and opening onto the platform 22, preferably two side access doors opening onto the platform 22, each side access door being provided on a respective side face of the car.

In the illustrated example, each platform 22 is served by two side access doors 30, 32 opening onto the platform 22, each side access door 30, 32 being provided on a respective side face 10, 12.

Each side face 10, 12 is thus provided with two side access doors 30, 32 each opening onto a respective platform 22.

Alternatively, only one of the two platforms 22 is served by one or two side access doors opening onto the platform 22.

Preferably, on a platform 22 equipped with a row of longitudinal seats 28 leaning against a side face 10, 12 and served by a side door 30, 32 provided on this side face 10, 12, the side access door 30, 32 is longitudinally located between the row of longitudinal seats 28 on the one hand and the descending passage 24 and the ascending passage 26 connecting the platform 22 to the lower floor 14 and to the upper floor 16, on the other hand.

In the illustrated example, each side access door 32 opens between a row of longitudinal seats 28 on the one hand and the descending passage 24 and the ascending passage 26 connecting the platform 22 to the lower floor 14 and to the upper floor 16, on the other hand.

The upper floor 16 and the lower floor 14 are laid out differently so as to provide different comfort levels for the passengers. In particular, the upper floor 16 and the lower floor 14 are equipped with different seats.

As visible in FIG. 3, the lower floor 14 is equipped with seats positioned in rows of seats comprising a common seat surface and/or back seat.

As illustrated, the seats of each seat row of the lower floor 14 have individual seat surfaces and a common back seat, alternatively, seats of a row having a common seat surface and individual back seats or a common seat surface and a common back seat.

The seats of the lower floor 14 are provided for passengers undertaking trips of average durations, typically between 15 and 30 minutes.

The lower floor 14 is equipped with transverse seats and/or longitudinal seats.

The lower floor 14 is here equipped with transverse seats and longitudinal seats. More specifically, the lower floor 14 is equipped with rows of transverse seats 34 placed against a side face 10, and with a row of longitudinal seats 36 leaning against the other side face 12. A row of transverse seats forms a transverse row. The rows of transverse seats 34 are separated from the row of longitudinal seats 36 by a circulation corridor 38 for the passengers. Alternatively, the lower floor 14 is exclusively equipped with rows of transverse seats.

As visible in FIG. 4, the upper floor 16 is provided with individual seats, preferably exclusively individual seats. Each individual seat has its respective individual back seat and its respective individual seat surface.

The seats of the upper floor 16 are intended for passengers undertaking relatively long trips, of typically more than 30 minutes.

The seats of the upper floor 16 are positioned transversely. The seats are positioned in rows of transverse seats 40, by delimiting a central circulation corridor for the passengers.

In an embodiment, the seats of the upper story 20 are different from those of the lower story 18 by their width: the seats of the upper story 20 have a greater width than those of the seats of the lower story 18.

As visible in FIGS. 3 and 4, both descending passages 24 are positioned transversely facing each other, and both ascending passages 26 are positioned transversely facing each other.

This allows a passenger on a platform 22 of seeing the other platform 22 through the lower story 18 with a relatively clear view avoiding sensation of confinement and increasing the feeling of safety. This further facilitates the circulation of the passengers by facilitating the crossing of each story.

Each ascending passage 26 and the descending passage 24 as a combination, connecting a same platform 22 to the upper floor 16 and to the lower floor 14, are positioned side by side. The ascending passage 26 is located against a side face 10, and the descending passage 24 is located against the other side face 12. Both ascending passages 26 are located against the same side face 10, and the two descending passages are located against the same side face 12.

The ascending passage 26 connecting a platform 22 to the upper floor 16 is narrower than the descending passage 24 connecting this platform 22 to the lower floor 14. The ratio of the width of the ascending passage 26 over that of the descending passage 24 is comprised between 0.4 and 0.8, notably between 0.6 and 0.8.

This gives the possibility of facilitating the circulation of the passengers by taking into account the respective frequency of use of the ascending and descending passages. Indeed, the descending passages connecting the platforms 22 to the lower story 18 provided for average trips are taken more frequently than the ascending passages connecting the platforms 22 to the upper story 20 provided for long trips.

The railway car comprises two information display banners (FIGS. 1 and 2) positioned inside the car, each on a respective side face 10, 12. Each information banner extends from one platform 22 to the other in a continuous way. Each information display banner extends here over the whole length of the car, from one end to the other.

The first information display banner 42 (FIG. 1) extends continuously on a side face along a platform 22, the upper story 20 and the other platform 22. This first information display banner 42 extends from one platform 22 as far as the other platform 22 by passing through the upper story 20. The first information display banner 42 passes through the ascending passages 26. This first information display banner 42 extends over the side face against which the ascending passages 26 are located.

The second information display banner 44 (FIG. 2) extends continuously on the other side face along a platform 22, the lower story 18 and the other platform 22. This second information display banner 44 extends from one platform 22 as far as the other platform 22 by passing through the lower story 18. This second information display banner 44 passes through the descending passages 24. This second information display banner 44 extends on the side face against which the descending passages are located.

Each information display banner 42, 44 bears one or several displays and/or one or several screens distributed along the information display banner.

The railway car 2 is provided at each of its longitudinal ends with an intercirculation passage 46 for passing from the railway car 2 to an adjacent railway car to which the railway car 2 is attached. Each intercirculation passage 46 opens onto a respective platform 22.

Each intercirculation passage 46 has a width extending over the majority of the width of the car, i.e. over more than 50% of its width. Advantageously, the width of the intercirculation passage 46 is greater than 60% of the width of the car, still preferably greater than 70% of the width of the car.

The wide intercirculation passages 46 facilitate circulation of the passengers and improve the visibility inside the cars, along a train formed with several cars in a line.

The platforms 22 define an area for the passengers undertaking short trips, the lower story 18 defines an area for passengers undertaking average trips and the upper story 20 defines an area for the passengers undertaking long trips.

Each area is equipped with seats for the passengers, each with fixtures of seats (orientation of the seats and/or comfort of the seats) different from those of the other areas.

By providing areas for the distinct passengers with different respective seat fixtures it is possible to provide to each passenger satisfactory comfort while promoting circulation of the passengers and allowing rapid boarding and disembarking.

The area for the short trips located on the platform 22 is immediately accessible. The longitudinal seats leaning against the side faces 10, 12 are easily and rapidly accessible, and free space in the middle of the platform 22 for circulation of the passengers or for passengers remaining standing in the case of crowding.

The area for the average trips (lower story 18) is rapidly accessible through relatively wider and shorter descending passages than the ascending passages. The rows of seats with a common back seat and/or common seat surface provide satisfactory comfort while giving the possibility of providing more seats and thereby increasing the number of seats for average trips with satisfactory comfort.

The area for long trips (upper story 20) is accessible through the relatively narrower and longer ascending passages than the descending passages. The individual seats provide satisfactory comfort for long trips. The upper story 20 provides an outward all-round visibility, which is more pleasant for long trips.

The wider descending passages 24 increase the ease of circulation of passengers upon boarding and disembarking and also increase the visibility in the car.

The wide intercirculation passages 46 facilitate circulation of the passengers between the cars and increases visibility along the train consisting of several cars.

The invention is not limited to the embodiment described. Alternatives may be contemplated.

In the illustrated example, each information display banner extends from one platform 22 to the other.

Thus, generally, the car comprises a continuous information display banner extending inside the car on a side face at least along a platform 22 and the upper story 20 and/or a continuous information display banner located inside the car and extending on a side face at least along a platform 22 and the upper story 20.

Generally, the area of average trips is defined by one of the lower story and of the upper story, and the area of long trips is defined by the other, each of the average trip area and the long trip area having respective fixtures of seats different from that of the other, the fixtures notably differing by the type of seats (individual or with a common back seat and/or common seat surface) and/or by the width of the seats.

The car here has two dedicated bogies on which rest the car. In an alternative, the box 4 rests on each end of a common bogie with an adjacent car. In another alternative, the box 4 rests on a bogie at a longitudinal end, and is provided so as to be suspended from the box 4 of an adjacent car at its other longitudinal end.

What is claimed is:

1. A two-floor passenger transport railway car, comprising:

a passenger compartment having, in a central segment of the compartment, a lower floor and an upper floor superposed with each respectively defining a lower story and an upper story, and, a first platform in a first end segment of the compartment and a second platform in a second end segment of the compartment, each of the first and second platforms being connected to the lower floor through a descending passage and to the upper floor through an ascending passage, wherein at least one of the first or second platform is equipped with at least one row of longitudinal seats leaning against a side face of the railway car, the at least one platform equipped with the at least one row of longitudinal seats is served by a side access door placed at the level of the platform on the side face against which the seats are leaning, the side access door is placed longitudinally between the at least one row of longitudinal seats and the descending passage or the ascending passage, the side access door is open to an outside of the railway car, each ascending passage connecting a respective platform to the upper floor is narrower than the descending passage connecting the respective platform to the lower floor, and each ascending passage comprises a staircase and at least one of the descending passage comprises a staircase wherein the ratio of the width of the ascending passage over that of the descending passage is comprised between 0.4 and 0.8.

2. The railway car according to claim 1, wherein the at least one platform is equipped with two rows of longitudinal seats, each leaning against a respective side face.

3. The railway car according to claim 1, further comprising a second side access door, such that each of the first and second platforms is served by a side access door.

4. The railway car according to claim 1, wherein the upper story and the lower story are provided with fixtures of seats with different respective comfort levels.

5. The railway car according to claim 1, wherein either the upper story or the lower story is equipped with at least one row of seats comprising a common back seat and/or a common seat surface, and the other is equipped with individual seats.

6. The railway car according to claim 1, wherein the lower story is equipped with at least one row of seats comprising a common back seat and/or a common seat surface, and the upper story is equipped with individual seats.

7. The railway car according to claim 1, comprising an information display banner located inside the railway car and continuously extending over a side face at least along the two platforms and the upper story.

8. The railway car according to claim 1, comprising an information display banner located inside the railway car and continuously extending over a respective side face at least along the two platforms and the lower story.

9. A railway train comprising at least one railway car according to claim 1.

10. The railway car according to claim 1, wherein the ratio of the width of the ascending passage over that of the descending passage is between 0.6 and 0.8.

11. The two-floor passenger transport railway car according to claim 2, wherein each of the first and the second platform is equipped with seats that consist of the two rows of longitudinal seats leaning against each respective side face.

12. The two-floor passenger transport railway car according to claim 3, wherein:

the longitudinal seats on the first platform are located on a first side of the side access door serving the first platform;

the ascending and descending passages from the first platform are located on a second side of the side access door serving the first platform;

the longitudinal seats on the second platform are located on the second side of the side access door serving the second platform;

the ascending and descending passages from the second platform are located on the first side of the side access door serving the second platform;

the upper floor comprises transverse seats on both sides with an upper aisle therebetween;

the lower level comprises longitudinal seats on a first side and transverse seats on the second side with a lower aisle therebetween, the lower aisle being wider than the upper aisle, and the lower aisle being aligned with the descending passage from each of the first and second platforms.

13. A two-floor passenger transport railway car, comprising:

a passenger compartment having, in a central segment of the compartment, a lower floor and an upper floor superposed with each respectively defining a lower story and an upper story, in end segments of the compartment, two platforms each connected to the lower floor through a descending passage and to the upper floor through an ascending passage, and at one or two longitudinal ends, an intercirculation passage, the width of which is greater than 50% of the width of the car, wherein at least one platform is equipped with at least one row of longitudinal seats leaning against a side face of the railway car, the at least one platform is served by a side access door placed at the level of the platform on the side face against which the seats are leaning, the access door is placed longitudinally between the at least one row of longitudinal seats and the descending passage or the ascending passage, and the side access door is open to an outside of the railway car wherein the ratio of the width of the ascending passage over that of the descending passage is comprised between 0.4 and 0.8.

14. The railway car according to claim 13, wherein the intercirculation passage has a width greater than 60% of the width of the car.

* * * * *